US010729266B2

(12) United States Patent
Tsai

(10) Patent No.: US 10,729,266 B2
(45) Date of Patent: Aug. 4, 2020

(54) ASSEMBLABLE ARTIFICIAL CHRISTMAS TREE

(71) Applicant: George Tsai, Taipei (TW)

(72) Inventor: George Tsai, Taipei (TW)

( * ) Notice: Subject to any disclaimer, the term of this patent is extended or adjusted under 35 U.S.C. 154(b) by 301 days.

(21) Appl. No.: 15/961,048

(22) Filed: Apr. 24, 2018

(65) Prior Publication Data

US 2019/0320837 A1 Oct. 24, 2019

(51) Int. Cl.

| | |
|---|---|
| ***A47G 33/00*** | (2006.01) |
| ***A47G 33/06*** | (2006.01) |
| *A41G 1/00* | (2006.01) |

(52) U.S. Cl.

CPC ..... *A47G 33/06* (2013.01); *A41G 1/007* (2013.01)

(58) Field of Classification Search

CPC ..... A47G 33/06; A47G 33/00; A41G 1/007
See application file for complete search history.

(56) References Cited

U.S. PATENT DOCUMENTS

2019/0110624 A1* 4/2019 Puleo ..... A47G 33/06

* cited by examiner

*Primary Examiner* — Alexander S Thomas
(74) *Attorney, Agent, or Firm* — Browdy and Neimark, PLLC

(57) ABSTRACT

An assemblable artificial Christmas tree includes a stand, a trunk, multiple branches and multiple leaves. One end of the trunk is connected with the stand. The trunk has multiple branch holders. One end of each branch is connected with a corresponding branch holder on the trunk. Each branch has a connection piece and at least one leafstalk seat attached to the connection piece. Each leafstalk seat has a connection tube. The connection tube includes a binding portion taking a saw-toothed shape, formed on a lower portion of a periphery of the connection tube, and fastened on the connection piece by a fastener. Each leaf is integrally formed by sheathing a resilient metal wire with plastic and is connected with a corresponding leafstalk seat to extend and spread out according to the position of the corresponding leafstalk seat so as to exhibit three-dimensional spatial perception.

7 Claims, 8 Drawing Sheets

ASSEMBLABLE ARTIFICIAL CHRISTMAS TREE

BACKGROUND OF THE INVENTION

1. Field of the Invention

The present invention relates to an artificial Christmas tree, more particularly, to an assemblable artificial Christmas tree.

2. Description of the Related Art

In view of its simple assembly, complete and beautiful tree structure, and easy storage and relocation, undoubtedly, an artificial Christmas tree is one of the most indispensable decorations during the Christmas holiday season. To give an artificial Christmas tree a natural and aesthetically appealing look, tree leaves are supposed to be correctly positioned and oriented as desired.

However, tree leaves of artificial Christmas trees available in the market must be manually adjusted by workers in the factory in terms of location and orientation of the tree leaves before shipment. Despite the availability of standard operation procedures for assembly of the artificial Christmas trees, under the circumstance that aesthetic judgment varies from person to person and product capacity is a major manufacturing concern, consistent and optimal shape of the artificial Christmas trees is hard to get. As warehousing and shipping costs are also critical to be taken into account, the artificial Christmas trees tend to be squeezed as much as possible especially when they are packed for shipping. After consumers receive and unpack the purchased artificial Christmas trees, tree leaves and branches of the artificial trees appear to be folded and distorted, giving a tree structure much less than expected by the consumers. Even though manufacturers of the artificial Christmas trees stress that the artificial Christmas trees may be made of steel wire, which is more rigid and less damage-prone, it is inevitable that the artificial Christmas trees eventually become distorted due to the weight and poor elasticity of the steel wires.

SUMMARY OF THE INVENTION

An objective of the present invention is to provide an assemblable artificial Christmas tree in a way that branch holders are arranged in a longitudinal direction of the trunk and spaced apart from each other, and leafstalks with leaves coupled thereto are easily tied to the respective branches to achieve a Christmas tree structure with three-dimensional spatial perception.

To achieve the foregoing objective, the assemblable artificial Christmas tree includes a stand, a trunk, multiple branches and multiple leaves.

The trunk has one end connected with the stand and includes multiple branch holders.

One end of each branch is connected with a corresponding branch holder, and each branch has a connection piece and at least one leafstalk seat.

The at least one leafstalk seat is attached to the connection piece. Each of the at least one leafstalk seat has a connection tube. The connection tube includes a binding portion taking a saw-toothed shape, formed on a lower portion of a periphery of the connection tube, and fastened on the connection piece by a fastener.

Each leaf has a resilient metal wire sheathed by a plastic material, and is connected with a corresponding leafstalk seat of a corresponding branch.

Preferably, the at least one leafstalk seat of each branch includes a leafstalk seat located at a tip portion of the branch and at least one leafstalk seat distributed over a portion of a periphery of the branch under the tip portion of the branch.

Preferably, each leafstalk seat has multiple leafstalks and multiple recesses.

Each leafstalk has a free end and a fixed end opposite to the free end and formed on the leafstalk seat.

Each recess is formed in a corresponding leafstalk in a longitudinal direction from the free end to the fixed end of the corresponding leafstalk.

Preferably, each leafstalk seat has multiple leafstalks and multiple recesses.

Each leafstalk has a free end and a fixed end opposite to the free end and formed on the leafstalk seat.

Each recess is formed in a corresponding leafstalk in a longitudinal direction from the free end to the fixed end of the corresponding leafstalk.

The multiple leafstalks and the multiple recesses of each leafstalk seat are arranged to align with a same plane or respectively align with different planes.

Preferably, one of the at least one leafstalk seat and a corresponding connection tube of each branch are connected to constitute a branch division.

Preferably, each branch has multiple leafstalk seats, and the multiple leafstalk seats and a corresponding connection tube of the branch are connected to constitute a branch division.

Preferably, the connection tube of each of the at least one leafstalk seat has a contact portion being a flat surface formed on an inner side of a top end of the connection tube for the connection tube to be attached to a corresponding branch.

Preferably, the fastener is a polypropylene wire and each leafstalk seat is tied on the connection piece of a corresponding branch by winding the polypropylene wire around the leafstalk seat to fasten the leafstalk seat on the connection piece.

The artificial Christmas tree has the advantages that the multiple branch holders are sequentially mounted along a longitudinal direction of the trunk for the leaves to be spread out after mounted on corresponding branches, the mounting ears of adjacent two of the branch holders are alternately arranged for exhibiting the artificial Christmas tree with three-dimensional spatial perception to viewers, each leafstalk seat is closely tied to a corresponding branch by using the fastener to wind around the saw-toothed binding portion of the leafstalk seat to fasten the binding portion on the connection piece of the corresponding branch, and the resilient metal wire inside each leaf facilitates the leaf to be flexible and bendable, rendering a small size beneficial to lower warehousing and storage costs when the artificial Christmas tree is subject to a compression force and restores its shape after the compression force is gone.

Other objectives, advantages and novel features of the invention will become more apparent from the following detailed description when taken in conjunction with the accompanying drawings.

DETAILED DESCRIPTION OF THE INVENTION

Figure 1:
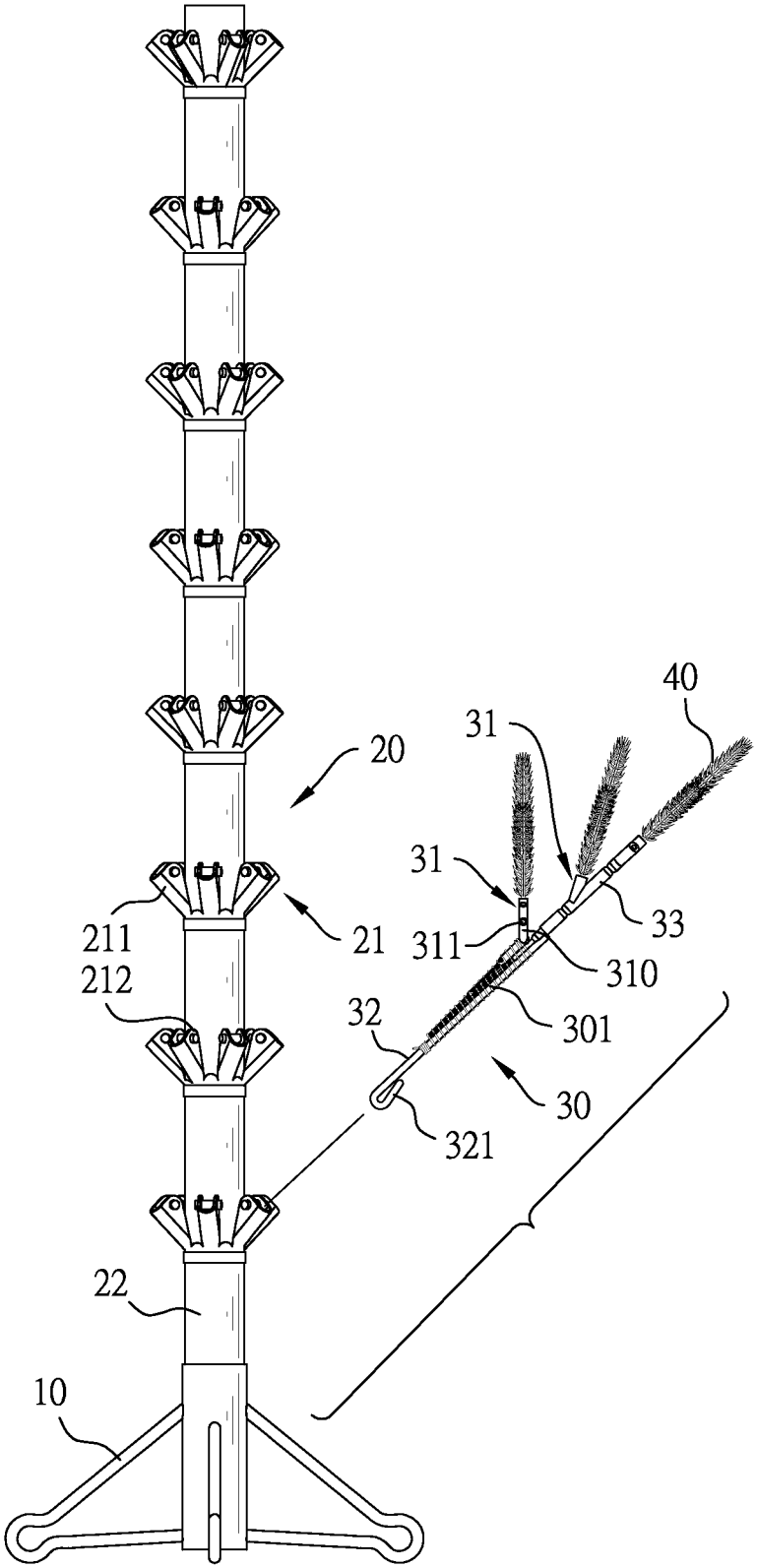
FIG. 1 is a front view of an assemblable artificial Christmas tree showing a stand, a trunk and a branch in accordance with the present invention.
Figure 2:
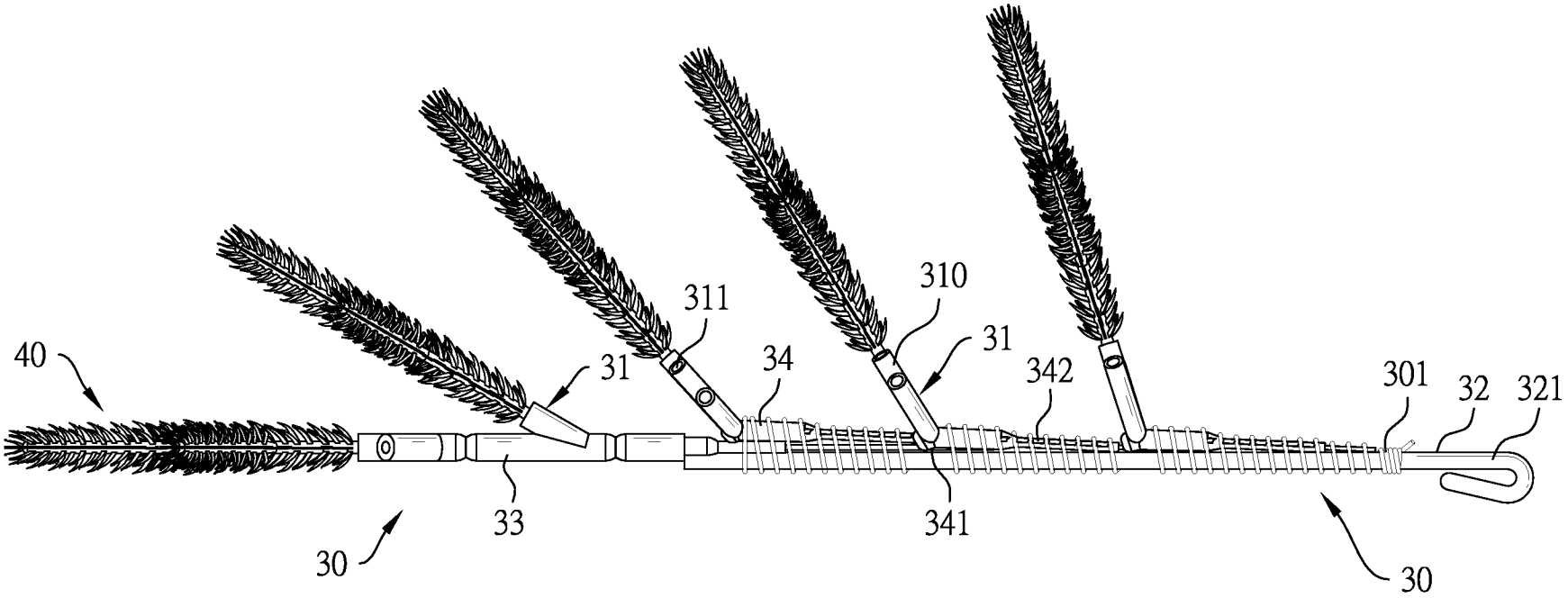
FIG. 2 is a side view of a branch with multiple leaves in accordance with the present invention.

With reference to FIGS. 1 and 2, an assemblable artificial Christmas tree in accordance with the present invention includes a stand 10, a trunk 20, at least one branch 30 and multiple leaves 40 connected with each of the at least one branch 30.

One end of the trunk 20 is connected with the stand 10 and has multiple branch holders 21. The multiple branch holders 21 are formed on the trunk 20 and spaced apart from each other by gaps in a longitudinal direction of the trunk 20. Each branch holder 21 has multiple mounting ears 211 and multiple lock pins 212. The multiple mounting ears 211 are annularly mounted around a rim of a bottom of the branch holder 21. The mounting ears 211 of each branch holder 21 and the mounting ear(s) 211 of the branch holder 21 located next thereto are alternately arranged. Each lock pin 212 is mounted through a portion of a corresponding mounting ear 211 distal to the trunk 20.

The trunk 20 may be integrally formed or may have multiple sleeves 22. The multiple sleeves 22 and the multiple branch holders 21 are alternately connected with each other along the longitudinal direction to form the trunk 20. Each branch holder 21 is connected between adjacent two of the sleeves 22, and each branch holder 21 and a sleeve 22 connected to the branch holder 21 constitute a trunk division. The trunk 20 is assembled or disassembled by connecting or disconnecting the trunk divisions.

Figure 3:
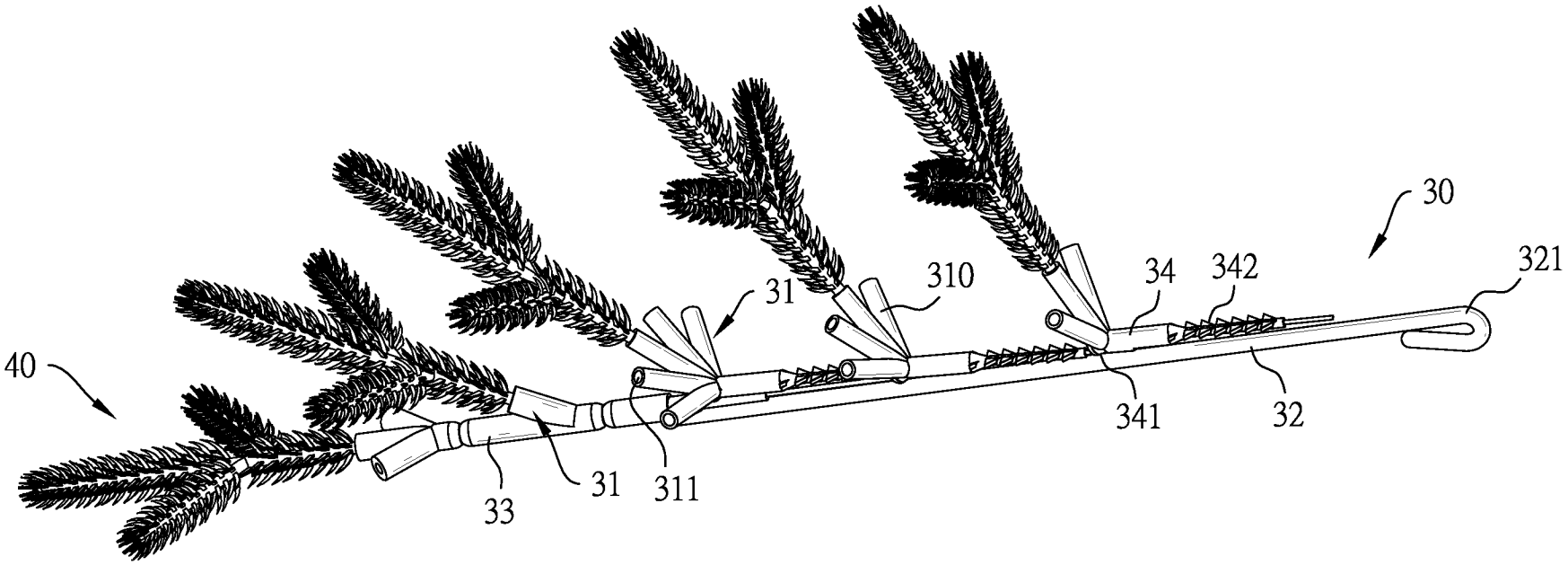
FIG. 3 is a perspective view of the branch with the multiple leaves in FIG. 2.

With reference to FIGS. 2 and 3, one end of each of the at least one branch 30 is connected with a corresponding mounting ear 211 of the trunk 20. As shown in FIG. 2, each of the at least one branch 30 includes multiple leafstalk seats 31 and a connection piece 32. The multiple leafstalk seats 31 are attached to the connection piece 32 and include a multiple leafstalk seat 31 located at a tip portion of the branch 30 and at least one leafstalk seat 31 distributed over a portion of a periphery of the branch 30 under the tip portion of the branch 30. Each leafstalk seat 31 has multiple leafstalks 310 and multiple recesses 311. Each recess 311 is formed in a corresponding leafstalk 310 in a longitudinal direction from a free end to a fixed end of the leafstalk 310 opposite to the free end and formed on the leafstalk seat 31, such that each leafstalk seat 31 is a multi-recess leafstalk seat to have multiple leaves mounted thereon. Each leafstalk seat 31 can be fastened on the connection piece 32 of a corresponding branch 30 by a fastener 301. Each branch 30 may have multiple multi-recess leafstalk seats 31 mounted thereon.

Preferably, the fastener 301 may be a polypropylene wire and each leafstalk seat 31 is tied on the connection piece 32 of the corresponding branch 30 by winding the polypropylene wire around the leafstalk seat 31 to fasten the leafstalk seat 31 on the connection piece 32. The multiple leafstalks 310 and the multiple recesses 311 of each leafstalk seat 31 are arranged to align with a same plane or respectively align with different planes to facilitate combining with the respective leaves 40 that are mounted between two ends of the corresponding branch 30. The fixed end of each leafstalk 310 of the leafstalk seat 31 is connected with the corresponding branch 30.

Figure 4:
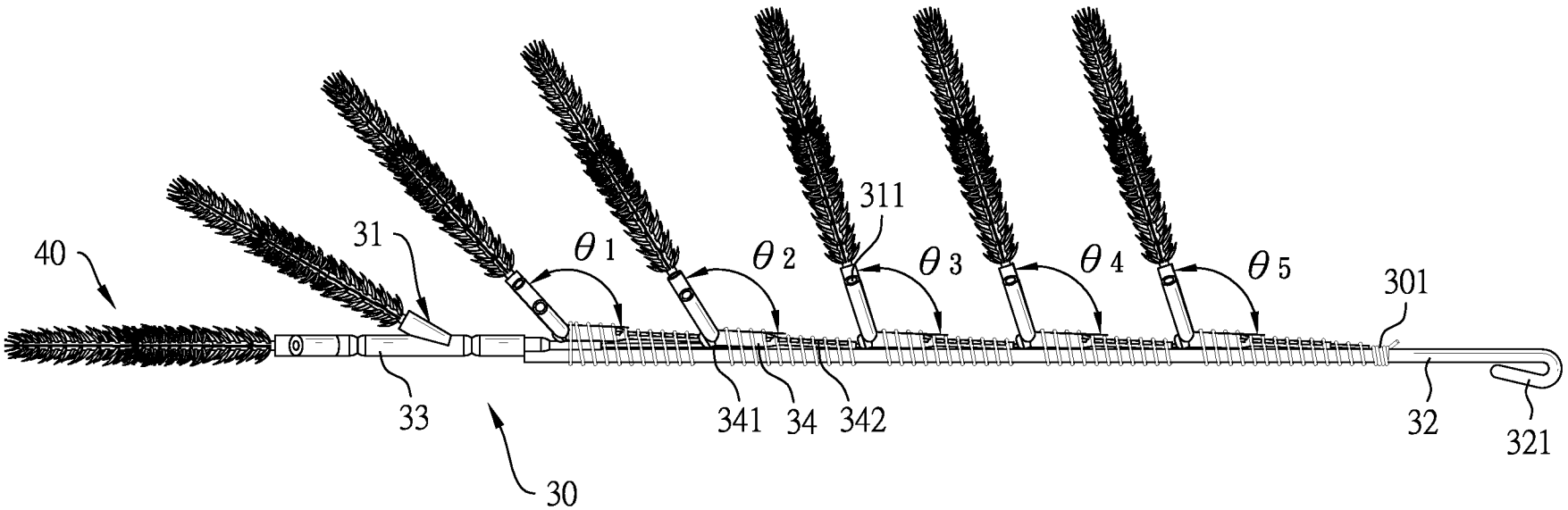
FIG. 4 is a side view of another branch and multiple leaves thereon in accordance with the present invention with an included angle between each leafstalk seat receiving a corresponding leaf and the branch.

An included angle is between a longitudinal direction of each leafstalk 310 of the leafstalk seat 31 and a longitudinal direction of the corresponding branch 30, $\theta_{1\sim5}$, as shown in FIG. 4. Each included angle may range between 0°~180°. Each branch 30 may be made by first sheathing an iron wire with a plastic material and then mounting the leafstalk seats 31 produced by other plastic forming processes on the plastic sheathed iron wire.

With reference to FIGS. 1 to 4, each branch 30 further includes a round hook 321 formed on one end of the connection piece 32 of the branch 30 and securely mounted around the lock pin 212 of a corresponding branch holder 21. Preferably, the round hook 321 of each branch 30 is an iron hook.

Preferably, a peripheral surface of each branch 30 may be bark-shaped, bark-free shaped, or bark-shaped over a top portion of the branch 30 and bark-free shaped over a bottom portion of the branch 30.

Figure 5:
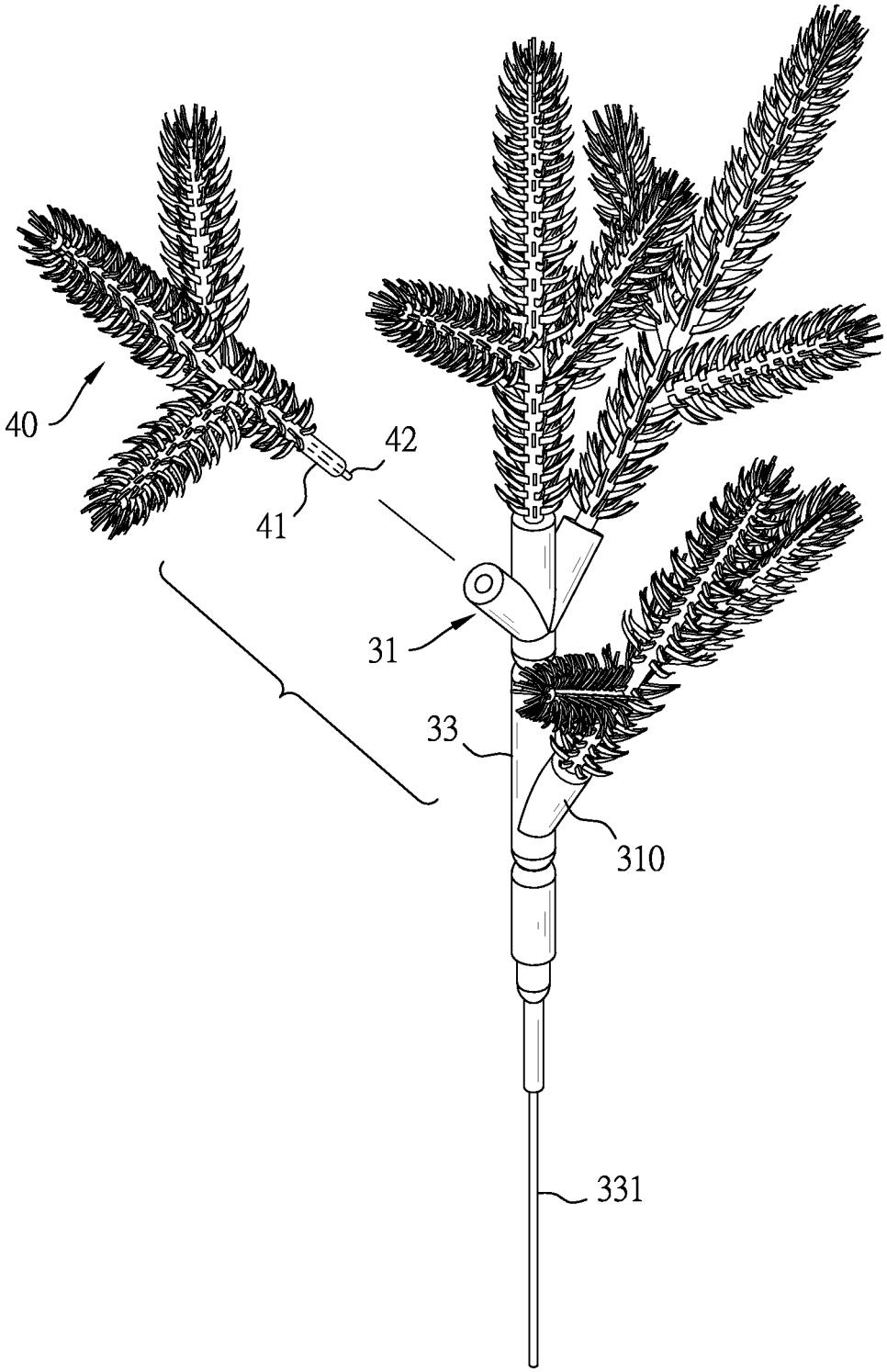
FIG. 5 is a partially exploded perspective view showing a connection tube of a branch assembled with multiple leaves in accordance with the present invention.

With reference to FIG. 5, the leafstalk seat 31 at the tip portion of each branch 30 further has a first connection tube 33. The first connection tube 33 has a pin 331 formed on a bottom portion thereof. The leafstalk seat 31 at the tip portion is formed on a top portion of the connection tube 33 and can be tied on the connection piece 32 of the branch 30 by using the fastener 301 to fasten the pin 331 of the connection tube 33 on the connection piece 32.

Figure 6:
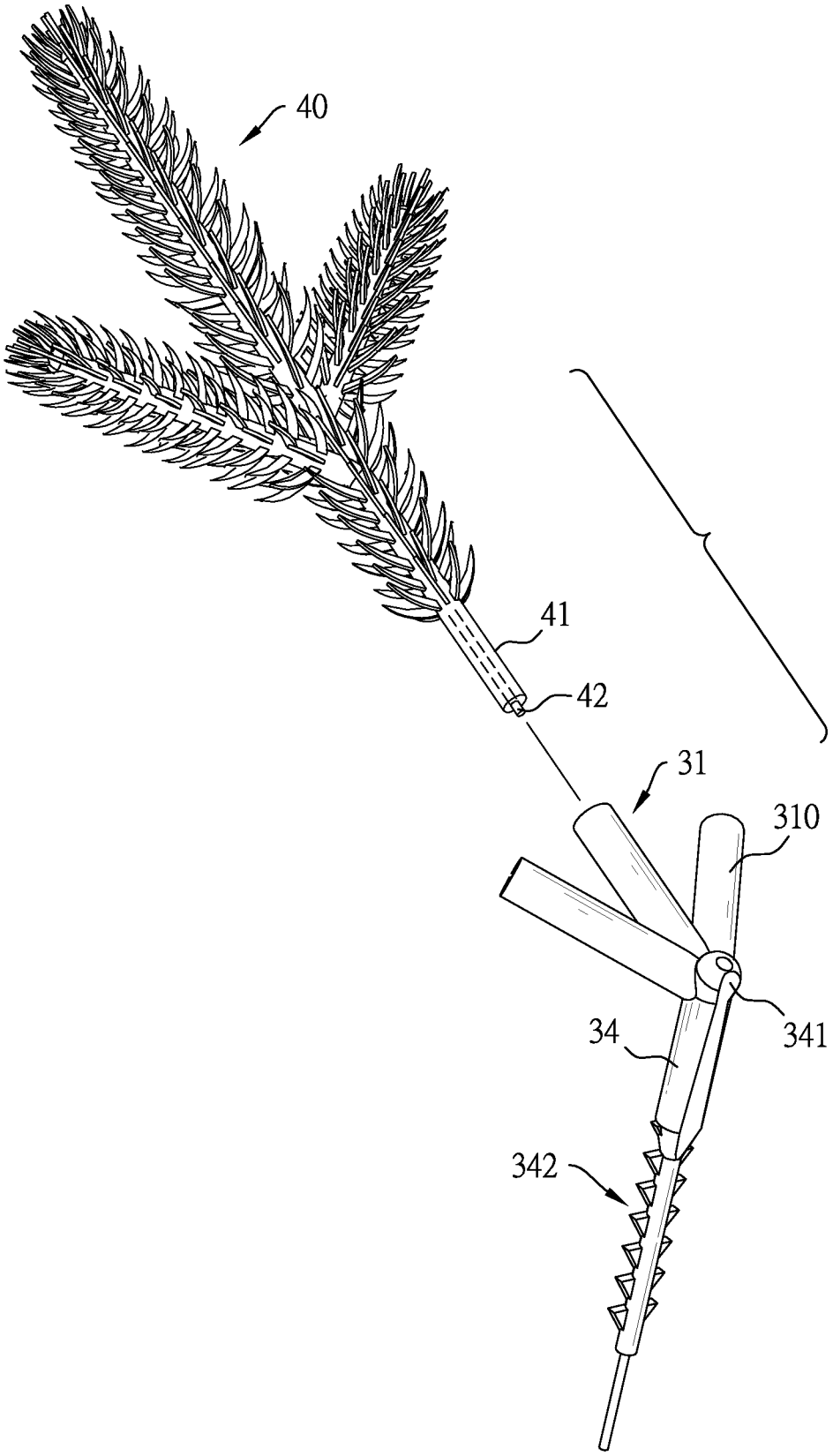
FIG. 6 is an exploded perspective view showing a leaf assembled with one of multiple leafstalk seats on a connection tube of a branch in accordance with the present invention.
Figure 7:
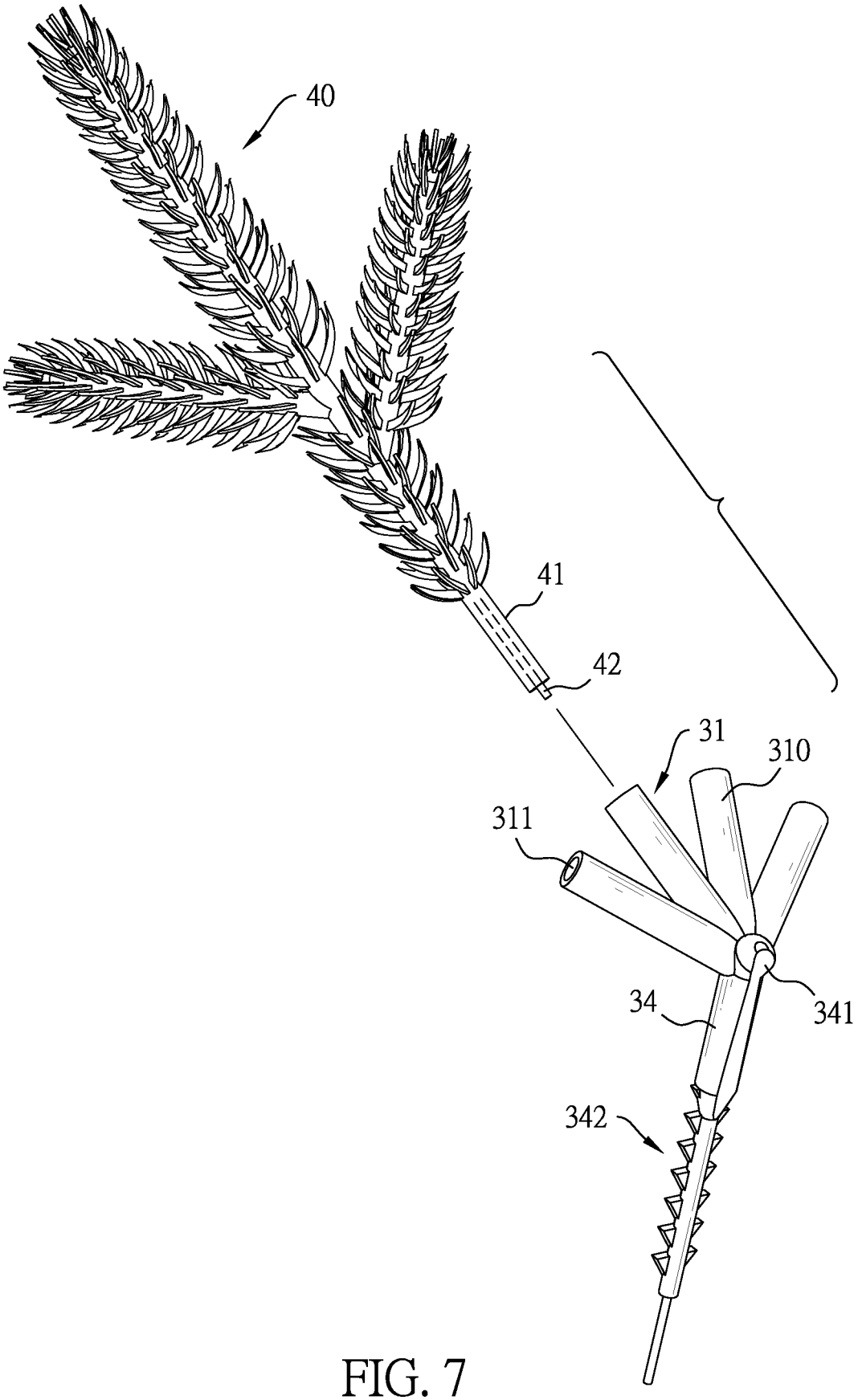
FIG. 7 is an exploded perspective view showing a leaf assembled with one of multiple leafstalk seats on another connection tube of a branch in accordance with the present invention.
Figure 8:
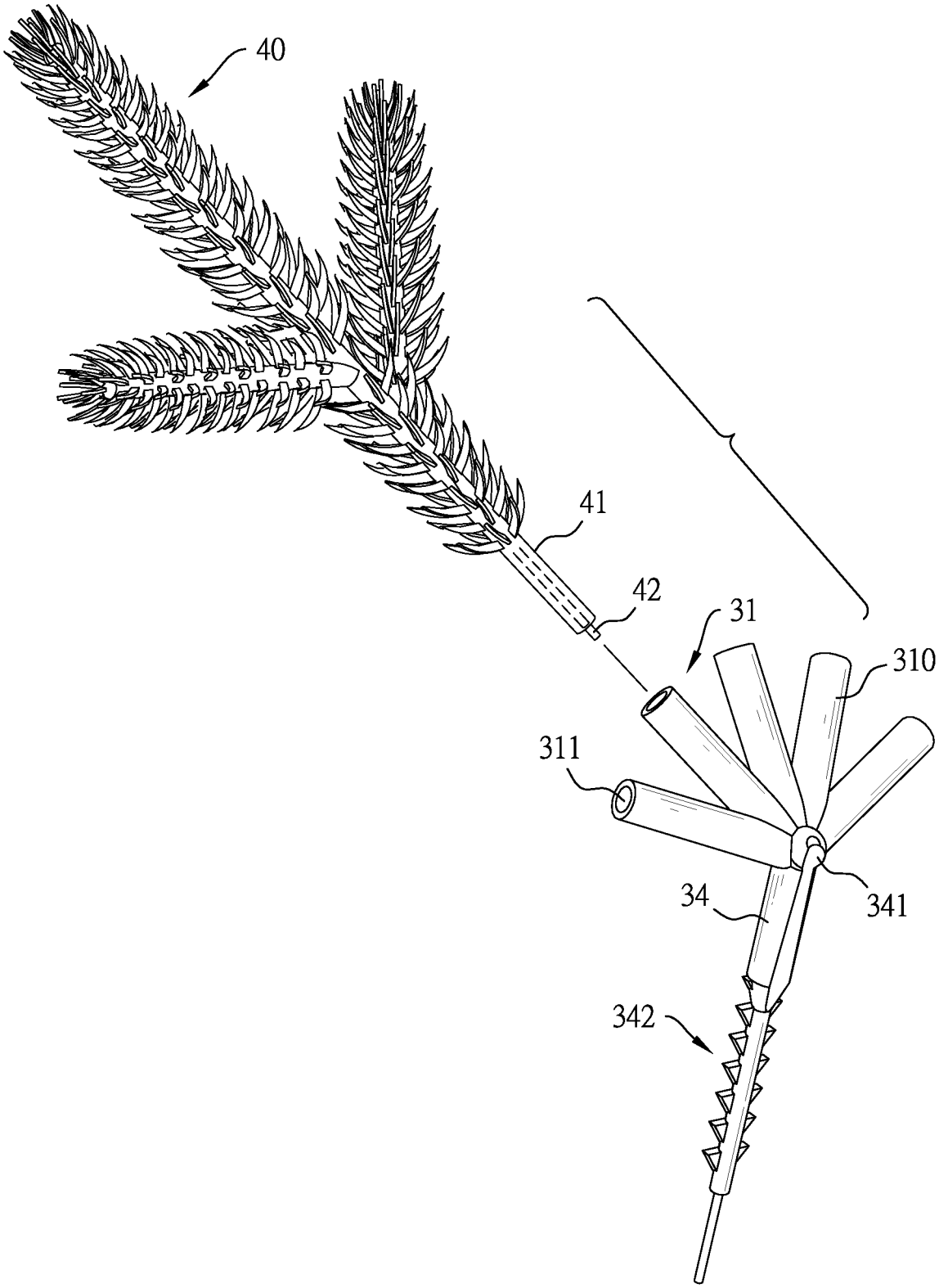
FIG. 8 is an exploded perspective view showing a leaf assembled with one of multiple leafstalk seats on yet another connection tube of a branch in accordance with the present invention.

With reference to FIGS. 6 to 8, each leafstalk seat 31 under the tip portion of each branch 30 has a second connection tube 34 and the multiple leafstalks 310 of the leafstalk seat 31 are formed on a top end of the second connection tube 34. The second connection tube 34 further has a contact portion 341 and a binding portion 342. The contact portion 341 is a flat surface formed on an inner side of a top end of the second connection tube 34 for the second connection tube 34 to be attached to the branch 30. The binding portion 342 takes a saw-toothed shape and formed on a lower portion of a periphery of the second connection tube 34. When each leafstalk seat 31 under the tip portion of a corresponding branch 30 is attached to the connection piece 32 of the corresponding branch 30, the binding portion 342 of the leafstalk seat 31 can be tied on the connection piece 32 of the corresponding branch 30 by using the fastener 301.

One of the leafstalk seats 31 and one of the first connection tube 33 and the second connection tubes 34 of each branch 30 adjacent to the leafstalk seat 31 constitute a branch division. Alternatively, multiple leafstalk seats 31 and one connection tube 33 constitute a branch division.

Each branch 30 can be assembled or disassembled by connecting or disconnecting the branch divisions.

With reference to FIGS. 6-8, one end of each leaf 40 is connected with a corresponding leafstalk seat 31 of a corresponding branch 30, and each leaf 40 has multiple leaflets formed on two lateral sides of the leaf 40 and located between a free end and the connected end of the leaf 40. There is no limitation concerning the shape of the leaflets. Preferably, the leaflets are needle-shaped as similar to those of Christmas trees. Each leaf 40 has an insertion end 41 and a resilient metal wire 42. The insertion end 41 is formed on a bottom portion of the leaf 40. The resilient metal wire 42 is sheathed by a plastic material to make the leaf 40 bendable. The resilient metal wire 42 is resilient, is made of flexible metal, and may be an iron wire. One end of the resilient metal wire 42 slightly protrudes beyond the plastic material and the slightly protruding end is trimmed during the assembly process of the leaf 40. Preferably, each leaf 40 may be integrally formed, or alternatively, each leaf 40 may be formed by adhesively attaching the leaflets to the plastic-sheathed resilient metal wire 42. Each leaf 40 is adhesively connected to a corresponding branch 30 with the insertion end 41 of the leaf 40 adhesively engaging the recess 311 of a corresponding leafstalk seat 31. Each leaf 40 has multiple insertion ends 41 formed on the bottom portion of the leaf 40 and is adhesively connected to a corresponding branch 30 with the multiple insertion ends 41 of the leaf 40 adhesively engaging the respective recesses 311 of a corresponding leafstalk seat 31.

With reference to FIG. 1, when the artificial Christmas tree is assembled, the branch holders 21 are mounted along the longitudinal direction of the trunk 20 and are spaced apart from each other, and each branch 30 is mounted in a corresponding mounting ear 211 of one of the branch holders 21, such that each leaf 40 can be extended and spread out according to the position of the corresponding mounting ear 211. As the mounting ears of each adjacent two of the branch holders 21 are alternately arranged, the leaves are directed to various directions for the artificial Christmas tree to exhibit three-dimensional spatial perception to viewers. Furthermore, since the included angle between each leafstalk seat 31 and a corresponding branch 30 on which the leafstalk seat 31 is formed ranges from 0 degree to 180 degrees and the multiple leafstalks 310 and the multiple recesses 311 of each leafstalk seat 31 can be arranged to align with a same plane, each leaf 40 can be arranged in a most appropriate manner in terms of location and orientation. Additionally, given the resilient metal wire 42 mounted inside each leaf 40, each leaf 40 possesses desirable elasticity and flexibility for the leaf 40 and a corresponding branch 30 to be closely attached to the corresponding branch 30 and to the trunk 20 when the leaf 40 and the corresponding branch 30 are subject to a compression force, such that the size of the artificial Christmas tree can be reduced to save warehousing and shipping costs. When the compression force is gone, the leaf 40 and the corresponding branch 30 can automatically bounce back to their original positions to exhibit an undistorted and original look without any effort for adjusting the branches 30 and the leaves 40.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An assemblable artificial Christmas tree, comprising:

a stand;

a trunk having one end connected with the stand and including multiple branch holders;

multiple branches, wherein one end of each branch is connected with a corresponding branch holder, each branch having:

a connection piece; and at least one leafstalk seat attached to the connection piece, each of the at least one leafstalk seat having a connection tube, wherein the connection tube includes a binding portion taking a saw-toothed shape, formed on a lower portion of a periphery of the connection tube, and fastened on the connection piece by a fastener; and multiple leaves, each leaf having a resilient metal wire sheathed by a plastic material, and connected with a corresponding leafstalk seat of a corresponding branch.

2. The assemblable artificial Christmas tree as claimed in claim 1, wherein the at least one leafstalk seat of each branch includes one of the at least one leafstalk seat located at a tip portion of the branch and the remaining leafstalk seats distributed over a portion of a periphery of the branch under the tip portion of the branch.

3. The assemblable artificial Christmas tree as claimed in claim 1, wherein each leafstalk seat has:

multiple leafstalks, each leafstalk having a free end and a fixed end opposite to the free end and formed on the leafstalk seat; and multiple recesses, each recess formed in a corresponding leafstalk in a longitudinal direction from the free end to the fixed end of the corresponding leafstalk.

4. The assemblable artificial Christmas tree as claimed in claim 1, wherein each leafstalk seat has:

multiple leafstalks, each leafstalk having a free end and a fixed end opposite to the free end and formed on the leafstalk seat; and multiple recesses, each recess formed in a corresponding leafstalk in a longitudinal direction from the free end to the fixed end of the corresponding leafstalk;

wherein the multiple leafstalks and the multiple recesses of each leafstalk seat are arranged to align with a same plane or respectively align with different planes.

5. The assemblable artificial Christmas tree as claimed in claim 1, wherein one of the at least one leafstalk seat and a corresponding connection tube of each branch are connected to constitute a branch division.

6. The assemblable artificial Christmas tree as claimed in claim 1, wherein each branch has multiple leafstalk seats, and the multiple leafstalk seats and a corresponding connection tube of the branch are connected to constitute a branch division.

7. The assemblable artificial Christmas tree as claimed in claim 1, wherein the connection tube of each of the at least one leafstalk seat has a contact portion being a flat surface formed on an inner side of a top end of the connection tube for the connection tube to be attached to a corresponding branch.

* * * * *